US009580787B2

(12) United States Patent
Höfener et al.

(10) Patent No.: US 9,580,787 B2
(45) Date of Patent: Feb. 28, 2017

(54) COATING METHOD USING SPECIAL POWDERED COATING MATERIALS AND USE OF SUCH COATING MATERIALS

(75) Inventors: Sebastian Höfener, Nürnberg (DE); Markus Rupprecht, Edelsfeld (DE); Christian Wolfrum, Erlangen (DE); Andreas Reis, Nürnberg (DE)

(73) Assignee: ECKART GMBH, Hartenstein (DE)

( * ) Notice: Subject to any disclaimer, the term of this patent is extended or adjusted under 35 U.S.C. 154(b) by 562 days.

(21) Appl. No.: 14/234,872

(22) PCT Filed: Jul. 25, 2012

(86) PCT No.: PCT/EP2012/064639

§ 371 (c)(1),
(2), (4) Date: Apr. 10, 2014

(87) PCT Pub. No.: WO2013/014214

PCT Pub. Date: Jan. 31, 2013

(65) Prior Publication Data

US 2014/0241937 A1 Aug. 28, 2014

(30) Foreign Application Priority Data

Jul. 25, 2011 (DE) ..... 10 2011 052 121

(51) Int. Cl.

| | |
|---|---|
| ***C23C 4/04*** | (2006.01) |
| ***C23C 4/06*** | (2016.01) |
| ***C23C 4/08*** | (2016.01) |
| ***C23C 4/10*** | (2016.01) |
| ***C23C 4/12*** | (2016.01) |
| ***C23C 24/04*** | (2006.01) |

(52) U.S. Cl.

CPC ..... *C23C 4/08* (2013.01); *C23C 4/04* (2013.01); *C23C 4/06* (2013.01); *C23C 4/10* (2013.01); *C23C 4/12* (2013.01); *C23C 4/123* (2016.01); *C23C 4/129* (2016.01); *C23C 4/134* (2016.01); *C23C 24/04* (2013.01)

(58) Field of Classification Search

CPC .... C23C 4/04; C23C 4/06; C23C 4/08; C23C 4/10; C23C 4/12; C23C 4/123; C23C 4/129; C23C 4/134; C23C 24/04

USPC ..... 420/469; 427/446, 450, 455, 456

See application file for complete search history.

(56) References Cited

U.S. PATENT DOCUMENTS

| | | | | |
|---|---|---|---|---|
| 4,513,020 | A * | 4/1985 | Dickson | C23C 4/06 427/456 |
| 5,141,769 | A | 8/1992 | Platz | |
| 5,207,382 | A | 5/1993 | Simm et al. | |
| 5,716,422 | A | 2/1998 | Muffoletto et al. | |
| 5,837,958 | A | 11/1998 | Fornsel | |
| 6,396,214 | B1 | 5/2002 | Grosse et al. | |
| 6,800,336 | B1 | 10/2004 | Fornsel et al. | |
| 7,678,428 | B2 | 3/2010 | Barbezat et al. | |
| 7,740,905 | B2 | 6/2010 | Jabado et al. | |
| 7,928,338 | B2 | 4/2011 | Suslov | |
| 8,038,887 | B2 | 10/2011 | Bakajin et al. | |
| 8,241,710 | B2 * | 8/2012 | Suss-Wolf | C23C 4/134 427/446 |
| 2003/0191009 | A1 | 10/2003 | Yu et al. | |
| 2004/0023078 | A1 | 2/2004 | Rosenflanz et al. | |
| 2004/0055153 | A1 | 3/2004 | Zahradnik et al. | |
| 2004/0191544 | A1 | 9/2004 | Bast et al. | |
| 2006/0081090 | A1 * | 4/2006 | Kitamura | C23C 4/04 75/255 |
| 2006/0134343 | A1 * | 6/2006 | Kato | C23C 4/06 427/446 |
| 2009/0202735 | A1 | 8/2009 | Marlin et al. | |
| 2009/0314520 | A1 | 12/2009 | Suss-Wolf et al. | |
| 2010/0152355 | A1 | 6/2010 | Schumacher et al. | |

(Continued)

FOREIGN PATENT DOCUMENTS

| | | |
|---|---|---|
| DE | 3941853 C1 | 4/1991 |
| DE | 19532412 A1 | 3/1997 |

(Continued)

OTHER PUBLICATIONS

Masakatsu Magome, "JIS How to Use Series, Manual for Spraying Technology", Japanese Standards Association, Oct. 30, 1998, First Edition, First Printing, pp. 32 to 35, 76 to 79 and 91 to 93.

*Primary Examiner* — Helene Klemanski
(74) *Attorney, Agent, or Firm* — The Webb Law Firm

(57) ABSTRACT

The invention relates to the use of a particle-containing powdered coating material in a coating method selected from the group consisting of cold gas spraying, flame spraying, high-speed flame spraying, thermal plasma spraying and non-thermal plasma spraying, wherein the particles have a relative deformability factor $V_m$ of at most 0.1 and the relative deformability factor is defined according to Formula (I):

$$V_m = \frac{d}{D_{50}}, \quad \text{(I)}$$

wherein d is the average smallest thickness of the particles, measured vertical to and in the middle half of the longitudinal axis of the particles, and $D_{50}$ is the average diameter of the volume-averaged particle-size distribution.

The invention furthermore relates to a method for coating.

25 Claims, 2 Drawing Sheets

(56) References Cited

U.S. PATENT DOCUMENTS

| | | | | |
|---|---|---|---|---|
| 2010/0196698 | A1* | 8/2010 | Trummer | B29C 65/1677 428/328 |
| 2011/0143039 | A1 | 6/2011 | Jakimov et al. | |
| 2014/0023856 | A1* | 1/2014 | Bisges | C23C 4/12 428/329 |
| 2014/0170410 | A1* | 6/2014 | Rupprecht | C23C 4/04 428/327 |
| 2014/0230692 | A1* | 8/2014 | Hofener | C23C 4/04 106/204.01 |
| 2014/0342094 | A1* | 11/2014 | Hofener | C23C 4/04 427/446 |

FOREIGN PATENT DOCUMENTS

| | | | |
|---|---|---|---|
| DE | 19807086 | A1 | 8/1999 |
| DE | 19856307 | C1 | 1/2000 |
| DE | 10000979 | C1 | 5/2001 |
| DE | 19955880 | A1 | 5/2001 |
| DE | 10116502 | A1 | 10/2002 |
| DE | 10320379 | A1 | 12/2004 |
| DE | 102006061435 | A1 | 6/2008 |
| DE | 102007006820 | A1 | 7/2008 |
| EP | 0254424 | A2 | 1/1988 |
| EP | 0342428 | B1 | 11/1989 |
| EP | 0492384 | A1 | 7/1992 |
| EP | 0344781 | B1 | 9/1992 |
| EP | 0825272 | A2 | 2/1998 |
| EP | 0830464 | B1 | 3/1998 |
| EP | 0911425 | B1 | 4/1999 |
| EP | 1024222 | A2 | 8/2000 |
| EP | 1287898 | A2 | 3/2003 |
| EP | 1363811 | B1 | 11/2003 |
| EP | 1365637 | A2 | 11/2003 |
| EP | 1 675 971 | B1 | 7/2006 |
| EP | 1675971 | B1 | 7/2006 |
| EP | 2104750 | A2 | 9/2009 |
| JP | 58-172298 | | 10/1983 |
| JP | 59-153877 | | 9/1984 |
| JP | 60-174862 | | 9/1985 |
| JP | 61-190060 | | 8/1986 |
| JP | 02-187177 | | 7/1990 |
| JP | 11-209833 | | 8/1999 |
| JP | 2005-527704 | | 9/2005 |
| JP | 2007-002273 | | 1/2007 |
| JP | 2007-521395 | A | 8/2007 |
| JP | 2009-505825 | A | 2/2009 |
| JP | 2009-062769 | A | 3/2009 |
| JP | 200974972 | A | 4/2009 |
| WO | 0132949 | A1 | 5/2001 |
| WO | 03064061 | A1 | 8/2003 |
| WO | 2004016821 | A2 | 2/2004 |
| WO | 2005-031026 | A1 | 4/2005 |
| WO | 2005031026 | A1 | 4/2005 |
| WO | 2006117144 | A1 | 11/2006 |
| WO | 2008077608 | A2 | 7/2008 |
| WO | 2009062769 | A1 | 5/2009 |
| WO | 2010003396 | A1 | 1/2010 |
| WO | 2010037548 | A1 | 4/2010 |

* cited by examiner

10 µm

10 µm

2 μm

2 μm

COATING METHOD USING SPECIAL POWDERED COATING MATERIALS AND USE OF SUCH COATING MATERIALS

CROSS-REFERENCE TO RELATED APPLICATIONS

This application is the United States national phase of International Application No. PCT/EP2012/064639 filed Jul. 25, 2012, and claims priority to German Patent Application No. 10 2011 052 121.6, filed Jul. 25, 2011, the entire disclosures of which are incorporated by reference herein.

BACKGROUND OF THE INVENTION

Field of the Invention

The present invention relates to special powdered coating materials. Furthermore, the present invention comprises the use of such powdered coating materials. Furthermore, the present invention comprises methods for substrate coating using such powdered coating materials.

Description of Related Art

A large number of coating methods for different substrates are already known. For example, metals or precursors thereof are deposited on a substrate surface from the gas phase, see e.g. PVD or CVD methods. Furthermore, corresponding substances can be deposited for example from a solution by means of galvanic methods. In addition, it is possible to apply coatings for example in the form of varnishes to the surface. However, all the methods have specific advantages and disadvantages. For example, in the case of deposition in the form of varnishes, large amounts of water and/or organic solvents are required, a drying time is needed, the coating material to be applied must be compatible with the base varnish, and a residue of the base varnish likewise remains on the substrate. For example, application by means of PVD methods requires large amounts of energy in order to bring non-volatile substances into the gas phase.

In view of the above-named limitations, a large number of coating methods have been developed to provide the properties desired for the respective intended use. Known methods use, for example, kinetic energy, thermal energy or mixtures thereof to produce the coatings, wherein the thermal energy can originate for example from a conventional combustion flame or a plasma flame. The latter are further divided into thermal and non-thermal plasmas, by which is meant that a gas is partially or completely separated into free charge carriers such as ions or electrons.

In the case of cold gas spraying, the coating is formed by applying a powder to a substrate surface, wherein the powder particles are greatly accelerated. For this, a heated process gas is accelerated to ultrasonic speed by expansion in a de Laval nozzle and then the powder is injected. As a result of the high kinetic energy, the particles form a dense layer when they strike the substrate surface.

For example, WO 2010/003396 A1 discloses the use of cold gas spraying as a coating method for applying wear-protection coatings. Furthermore, disclosures of the cold gas spraying method are found for example in EP 1 363 811 A1, EP 0 911 425 B1 and U.S. Pat. No. 7,740,905 B2.

Flame spraying belongs to the group of thermal coating methods. Here, a powdered coating material is introduced into the flame of a fuel gas/oxygen mixture. Here, temperatures of up to approximately 3200° C. can be reached for example with oxyacetylene flames. Details of the method can be learned from publications such as e.g. EP 830 464 B1 and U.S. Pat. No. 5,207,382 A.

In the case of thermal plasma spraying, a powdered coating material is injected into a thermal plasma. In the typically used thermal plasma, temperatures of up to approx. 20,000 K are reached, whereby the injected powder is melted and deposited on a substrate as coating.

The method of thermal plasma spraying and specific embodiments, as well as method parameters are known to a person skilled in the art. By way of example, reference is made to WO 2004/016821, which describes the use of thermal plasma spraying to apply an amorphous coating. Furthermore, EP 0 344 781 for example discloses the use of flame spraying and thermal plasma spraying as coating methods using a tungsten carbide powder mixture. Specific devices for use in plasma spraying methods are described multiple times in the literature, such as for example in EP 0 342 428 A2, U.S. Pat. No. 7,678,428 B2, U.S. Pat. No. 7,928,338 B2 and EP 1 287 898 A2.

In the case of high-speed flame spraying, a fuel is combusted under high pressure, wherein fuel gases, liquid fuels and mixtures thereof can all be used as fuel. A powdered coating material is injected into the highly accelerated flame. This method is known for being characterized by relatively dense spray coatings. High-speed flame spraying is also well known to a person skilled in the art and has already been described in numerous publications. For example, EP 0 825 272 A2 discloses a substrate coating with a copper alloy using high-speed flame spraying. Furthermore, WO 2010/037548 A1 and EP 0 492 384 A1 for example disclose the method of high-speed flame spraying and devices to be used therein.

Non-thermal plasma spraying is carried out largely analogously to thermal plasma spraying and flame spraying. A powdered coating material is injected into a non-thermal plasma and deposited with it onto a substrate surface. As can be learned for example from EP 1 675 971 B1, this method is characterized by a particularly low thermal load of the coated substrate. This method, particular embodiments and corresponding method parameters are also known to a person skilled in the art from different publications. For example, EP 2 104 750 A2 describes the use of this method and a device for carrying it out. For example, DE 103 20 379 A1 describes the production of an electrically heatable element using this method. Further disclosures in respect of the method or devices for non-thermal plasma spraying are found for example in EP 1 675 971 B1, DE 10 2006 061 435 A1, WO 03/064061 A1, WO 2005/031026 A1, DE 198 07 086 A1, DE 101 16 502 A1, WO 01/32949 A1, EP 0 254 424 B1, EP 1 024 222 A2, DE 195 32 412 A1, DE 199 55 880 A1 and DE 198 56 307 C1.

However, a general problem of coating methods using a powdered coating material is that under relatively gentle coating conditions only an insufficient coating quality is achieved. In particular, when there is an incomplete melting of the particles of the powdered coating material, cavities form which can for example influence the optical, haptic or electrical properties, the barrier effect and/or the heat conductivity of the coating.

SUMMARY OF THE INVENTION

An object of the present invention is to provide a powdered coating material suitable for use in coating methods, wherein the production of known coatings is improved or the production of new coatings is made possible.

A further object of the present invention is to provide a method through which the production of a high-quality and homogeneous coating is made possible under the gentlest possible coating conditions (temperature, speed of the particles that strike).

A further object of the present invention is the provision of a powdered coating material which provides advantages compared with the known powdered coating materials when used in the coating of substrates.

The present invention relates to the use of a particle-containing powdered coating material in a coating method selected from the group consisting of cold gas spraying, flame spraying, high-speed flame spraying, thermal plasma spraying and non-thermal plasma spraying, wherein the particles have a relative deformability factor $V_m$ of at most 0.1 and the relative deformability factor is defined according to Formula (I):

$$V_m = \frac{d}{D_{50}}. \tag{I}$$

In some non-limiting embodiments, the present invention provides a method for coating a substrate selected from the group consisting of cold gas spraying, flame spraying, high-speed flame spraying, thermal plasma spraying and non-thermal plasma spraying, the method comprising: (a) introducing a particle-containing powdered coating material into a medium directed onto a substrate to be coated by cold gas spraying, flame spraying, high-speed flame spraying, thermal plasma spraying or non-thermal plasma spraying, wherein the particles have a relative deformability factor $V_m$ of at most 0.1 and the relative deformability factor is defined according to Formula (I):

$$V_m = \frac{d}{D_{50}}, \tag{I}$$

wherein d is the average smallest thickness of the particles, measured vertical to and in the middle half of the longitudinal axis of the particles, and $D_{50}$ is the average diameter of the volume-averaged particle-size distribution; and (b) depositing the powdered coating material onto the substrate.

BRIEF DESCRIPTION OF THE DRAWINGS

The foregoing summary, as well as the following detailed description, will be better understood when read in conjunction with the appended drawings. In the drawings.

DETAILED DESCRIPTION

Figure 1:
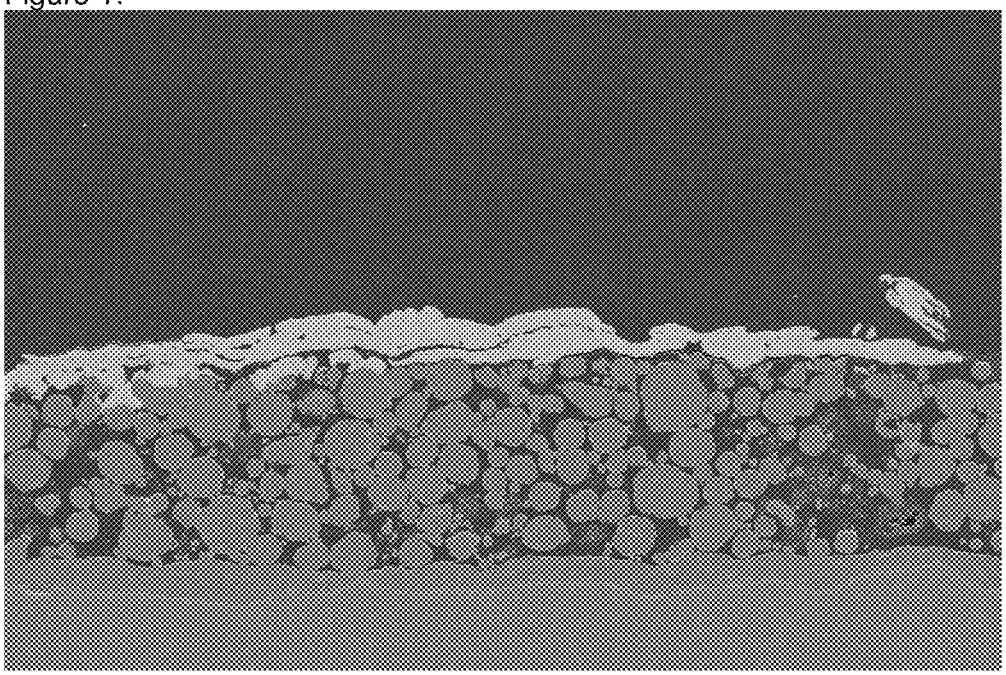
FIG. 1 is an SEM photograph of a wafer which was coated first by means of solar contact paste and then by means of non-thermal plasma spraying, wherein a powdered copper coating material according to the invention was used.

Here, $V_m$ denotes the relative deformability factor. Furthermore, d denotes the average smallest thickness of the particles, measured vertical to and in the middle half of the longitudinal axis of the particles. To determine this thickness, at least 50 randomly selected particles are measured and the average value formed therefrom. The term $D_{50}$ is the average particle size at which 50% of the volume-averaged particle-size distribution lies below the named size. The $D_{50}$ is preferably determined by means of laser granulometry, wherein for example a HELOS-type particle-size analyzer from Sympatec GmbH, Clausthal-Zellerfeld, Germany, is used. The dispersing of a dry powder can be carried out here with a dispersing unit of the Rodos T4.1 type at a primary pressure of, for example, 4 bar. Alternatively, the size distribution curve of the particles can be measured, for example, with a device from Quantachrome (device: Cilas 1064) according to the manufacturers instructions. For this, 1.5 g of the powdered coating material is suspended in approx. 100 ml isopropanol, treated for 300 seconds in an ultrasound bath (device: Sonorex IK 52, Bandelin) and then introduced by means of a Pasteur pipette into the sample preparation cell of the measuring device and measured several times. The resultant average values are formed from the individual measurement results. The scattered light signals are evaluated according to the Fraunhofer method.

In particular embodiments of the above-named use, the relative deformability factor is defined according to Formula (II) taking into account the Mohs hardness of the particles relative to the Mohs hardness of silver:

$$V_m = \frac{d}{D_{50}} \cdot \frac{H_X}{H_{Ag}}, \tag{II}$$

wherein $H_X$ is the Mohs hardness of the particles and $H_{Ag}$ is the Mohs hardness of silver. The Mohs hardness of silver is to be used for substances X with a Mohs hardness ($H_X$) smaller than the Mohs hardness of silver ($H_{Ag}$).

In particular embodiments of the above-named uses, the relative deformability factor of the powdered coating material is at most 0.01.

In particular embodiments of the above-named uses, the technical elastic limit of the particles of the powdered coating material is more than 45 $N/mm^2$.

In particular embodiments of the above-named uses, the melting point, measured in [K], of the coating material is up to 60% of the temperature, measured in [K], of the medium used in the coating method directed onto the substrate, for example the gas stream, the combustion flame or the plasma flame.

In particular embodiments of the above-named uses, the particles of the powdered coating material comprise or are metal particles, wherein the metal is selected from the group consisting of silver, gold, platinum, palladium, vanadium, chromium, manganese, cobalt, germanium, antimony, aluminum, zinc, tin, iron, copper, nickel, titanium, silicon, alloys and mixtures thereof.

In particular embodiments of the above-named uses, the coating method is selected from the group consisting of flame spraying and non-thermal plasma spraying. In particular ones of the above-named embodiments, the coating method is preferably non-thermal plasma spraying.

In particular embodiments of the above-named uses, the powdered coating material has a particle-size distribution with a $D_{50}$ value from a range of from 1.5 to 84 μm.

In particular embodiments of the above-named uses, the powdered coating material has a particle-size distribution with a $D_{10}$ value from a range of from 3.7 to 26 μm, a $D_{50}$ value from a range of from 6 to 49 μm and a $D_{90}$ value from a range of from 12 to 86 μm.

In particular embodiments of the above-named uses, the span of the powdered coating material is at most 2.9, wherein the span is defined according to Formula (III):

$$\text{Span} = \frac{D_{90} - D_{10}}{D_{50}}. \quad \text{(III)}$$

In particular embodiments of the above-named uses, the particles of the powdered coating material are at least partially coated. In particular ones of the above-named embodiments, the particles of the powdered coating material are coated.

The present invention furthermore relates to a method for coating a substrate selected from the group consisting of cold gas spraying, flame spraying, high-speed flame spraying, thermal plasma spraying and non-thermal plasma spraying, wherein the method comprises the step that a particle-containing powdered coating material is introduced into a medium directed onto the substrate, wherein the particles have a relative deformability factor $V_m$ of at most 0.1 and the relative deformability factor is defined according to Formula (I):

$$V_m = \frac{d}{D_{50}}, \quad \text{(I)}$$

wherein d is the average smallest thickness of the particles, measured vertical to and in the middle half of the longitudinal axis of the particles, and $D_{50}$ is the average diameter of the volume-averaged particle-size distribution.

In particular embodiments of the above-named method, the method is selected from the group consisting of flame spraying and non-thermal plasma spraying. The coating method is preferably non-thermal plasma spraying in particular ones of the above-named embodiments.

In particular embodiments of the above-named methods, the powdered coating material is conveyed as an aerosol.

In particular embodiments of the above-named methods, the medium directed onto the substrate is air or has been produced from air. The above-named air can be taken from the surrounding atmosphere. In particular embodiments, in which for example a particularly high purity of the coating is desired, the air is purified before it is used, wherein for example dust and/or water vapor is separated off. It can likewise be preferred that the gaseous constituents of the air, other than nitrogen and oxygen, are also largely separated off completely, (total amount <0.01 vol.-%, preferably <0.001 vol.-%).

The term "powdered coating material" within the meaning of the present invention relates to a particle mixture which is applied to the substrate as coating. It is not necessary here that the particles according to the invention of the powdered coating material have a uniform thickness. Without being understood as limiting the invention, the inventors are of the view that the particles according to the invention of the powdered coating material can be mechanically deformed particularly easily and can thereby fill unevennesses of the substrate and holes in the already applied coating much more easily, without it being necessary to melt the particles by means of a large amount of thermal energy or greatly accelerate them in order to provide sufficient kinetic energy for deformation. This is observed for example not only in uniformly thin particles, but also in particles of irregular thickness, as the thinnest points here, in the inventors' view, are as weak points particularly easily deformable and a particularly easy adaptation to the undersurface is made possible as a result of the deformation of the particles at such weak points.

To the inventors' surprise, it was found that by using the powdered coating material according to the invention much more homogeneous coatings with a reduced number and size of cavities, or even completely without cavities, can also be obtained under very gentle conditions. This is achieved through the production and the use of powdered coating materials which have a particularly high relative deformability. This high relative deformability is effected by very thin points or areas relative to the average size of all of the particles. Without being understood as limiting the invention, the inventors are of the view that such thin points or areas have weak points at which a deformation of the particles can take place particularly easily. As a result, a particularly good adaptation to for example the surface structure of the substrate takes place even under very gentle conditions.

In addition, it was surprisingly observed that the powdered coating material according to the invention sprays off from the surface of the substrate during the application of the coating to a lesser extent. Without being understood as limiting the invention, the inventors are of the view that the higher mechanical deformability of the particles according to the invention results in an easier conversion of the kinetic energy into a deformation of the particle, whereby the tendency towards an elastic impact resulting in a spraying off of the particles from the substrate to be coated is reduced, which is particularly advantageous for example when expensive or poorly recyclable coating materials are used. This effect is particularly important for methods using high gas speeds, in particular for example cold gas spraying and high-speed flame spraying.

The particles according to the invention of the powdered coating material are therefore characterized by the above-named upper limit of the relative deformability factor. The relative deformability factor is defined according to Formula I $$V_m = \frac{d}{D_{50}} \quad \text{(I)}$$

Here, $V_m$ denotes the relative deformability factor. Furthermore, d denotes the average smallest thickness of the particles, measured vertical to and in the middle half of the longitudinal axis of the particles. To determine this average thickness, at least 50 randomly selected particles are measured by means of SEM and the average value formed therefrom. The term $D_{50}$ denotes the average particle size at which 50% of the volume-averaged particle-size distribution lies below the named size. The $D_{50}$ is preferably determined by means of laser granulometry, wherein for example a HELOS-type particle-size analyzer from Sympatec GmbH, Clausthal-Zellerfeld, Germany, is used.

However, the mechanical deformability of the particles is also dependent to a certain extent on the hardness of the material used. In particular embodiments, it can therefore be preferred to introduce a correction factor based on the Mohs hardness of the material, provided the Mohs hardness is greater than that of silver. However, for substances with a Mohs hardness less than that of silver, such a correction is only negligible, which is why the Mohs hardness of silver is used for such substances. The corrected relative deformability factor is calculated here from Formula II $$V_m = \frac{d}{D_{50}} \cdot \frac{H_X}{H_{Ag}} \quad \text{(II)}$$

Here, $H_{Ag}$ is the Mohs hardness of silver (2.7) and $H_X$ is the Mohs hardness of the material of the particles of the powdered coating material.

In cases in which the particles of the powdered coating material were provided with a coating the Mohs hardness of which is greater than that of the underlying material, the relevant Mohs hardness of the powdered coating material is calculated according to Formula IV by totaling the Mohs hardnesses of the materials of the layers corrected by the relative proportion of the relevant layer to the total thickness:

$$H_X = r_1 * H_1 + r_2 * H_2 + \ldots \quad \text{(IV)}$$

Here, $r_x$ denotes the average proportion of the thickness of layer X relative to all of the particles. The average thickness of the layer is preferably determined by means of SEM by measuring 50 randomly selected particles.

In particular embodiments, it is preferred in particular that the relative deformability factor according to Formula (I) or (II), optionally taking into account Formula (IV), of the powdered coating material according to the invention has a relative deformability factor of at most 0.1, preferably of at most 0.07, more preferably of at most 0.05 and still more preferably at most 0.03. In particular ones of the above-named embodiments, it is preferred in particular that the relative deformability factor of the powdered coating material is at most 0.01, preferably at most 0.007, more preferably at most 0.005 and still more preferably at most 0.003.

Methods according to the invention which can be used to build up coatings are cold gas spraying, thermal plasma spraying, non-thermal plasma spraying, flame spraying and high-speed flame spraying. The use of the powdered coating materials according to the invention has a particularly marked effect in methods in which no particularly high kinetic energies are transferred to the particles, as a sufficient deformation of the particles is achieved even at much lower speeds. In particular embodiments, it is therefore preferred that the method is selected from the group consisting of thermal plasma spraying, non-thermal plasma spraying and flame spraying.

Many powdered coating materials are completely melted in the thermal plasma during thermal plasma spraying, with the result that only a liquid strikes the surface of the substrate and the additional outlay associated with the provision of the powdered coating materials according to the invention is uneconomical. In particular embodiments, the method is therefore selected from the group consisting of cold gas spraying, non-thermal plasma spraying, flame spraying and high-speed flame spraying, preferably from the group consisting of non-thermal plasma spraying and flame spraying.

The use of a plasma provides the advantage that even non-combustible gases can be used as plasma gas, whereby the outlay on equipment and in particular the burden of necessary safety precautions are reduced. Thus in most cases a harmless gas that is easy to handle can be used and small amounts of other gases can be kept in reserve for specific method variants. In particular embodiments, it is therefore preferred that the method is selected from the group consisting of thermal plasma spraying and non-thermal plasma spraying. In particular ones of the above-named embodiments, it is preferred in particular that non-thermal plasma spraying is used as coating method.

It was furthermore surprisingly found that by means of the powdered coating materials according to the invention, particularly homogeneous coatings can also be produced under gentle coating conditions from substances which have a high yield stress. The yield stress is a relative limit value which describes a relationship between the stress exerted on a material the plastic deformation resulting therefrom. The 0.2% yield stress, which is also called the technical elastic limit, is of particular importance here. In particular embodiments, it is preferred that the technical elastic limit of the coating material used is more than 45 N/mm$^2$, preferably more than 70 N/mm$^2$, more preferably more than 85 N/mm$^2$ and still more preferably more than 100 N/mm$^2$. In particular ones of the above-named embodiments, it is preferred in particular that the technical elastic limit of the coating material according to the invention is more than 130 N/mm$^2$, preferably more than 160 N/mm$^2$, more preferably more than 190 N/mm$^2$ and even more preferably more than 210 N/mm$^2$. The technical elastic limit is determined here according to DIN EN ISO 6892. Without being understood as limiting the invention, the inventors are of the view that powdered coating materials used to date, when gentle coating conditions are used, were not sufficiently deformable upon striking the surface, were therefore unable to adequately adapt to the surface structure or structure of the already applied coating and incorporated cavities. However, in the case of the powdered coating materials according to the invention it is no longer necessary for all of the particles to be deformed, instead only the thin points or areas according to the invention need be deformed in order to make possible an adaptation to the surface structure present. Therefore much smaller forces are required to deform substances with a high technical elastic limit and much gentler coating conditions can be used for the coating according to the invention.

In addition, it was surprisingly found that even easily accessible particles with clearly non-uniform thickness can be used according to the invention. Without being understood as limiting the invention, the inventors are of the view that the above-named points of the smallest thickness of the particles decisively influence the deformability and also much thicker points or areas that are present do not seriously interfere with the adaptation of the particles to for example the surface of the substrate. It can therefore be preferred to use such non-uniform particles in order for example to save on the additional outlay of providing particularly uniformly shaped particles. In particular embodiments, it is therefore preferred that the average ratio of the largest thickness to the smallest thickness, measured vertical to and in the middle half of the longitudinal axis of the particles, is at least 1.3, preferably at least 1.4, more preferably at least 1.5 and still more preferably at least 1.6. In particular embodiments, it is preferred in particular that the average ratio of the thickest point to the thinnest point, measured vertical to and in the middle half of the longitudinal axis of the particles, is at least 1.8, preferably at least 2.0, more preferably at least 2.2 and still more preferably at least 2.4. The average largest thickness is determined analogously to the determination of the above-named average smallest thickness. The average ratio of the largest thickness to the smallest thickness is calculated using the average value of the ratio of at least 50 randomly selected particles.

Furthermore, the inventors have surprisingly found that by using the mechanically easily deformable powdered coating materials according to the invention the use of coating materials with an unexpectedly high melting point is also made possible. Without being understood as limiting the invention, the inventors are of the view that, as a result of the kinetic energy used in the coating method, the particles selected according to the invention of the powdered coating material already have an at least largely sufficient amount of energy available to them in order to adapt the particles to the substrate surface or the holes between already applied particles. If a thermal component is actually required, a much smaller amount of thermal energy is required to make it possible to firmly bind the applied particles accompanied by formation of a homogeneous layer.

For example, in particular embodiments, powdered coating materials according to the invention can also be used to produce homogeneous layers if the melting point, measured in [K], of the particles of the coating material is up to 60%, preferably up to 70%, more preferably up to 80% and still more preferably up to 85% of the temperature, measured in [K], of the medium used in the coating method, for example the gas stream, the combustion flame and/or the plasma flame. Furthermore, in particular ones of the above-named embodiments, particle-containing powdered coating materials to be used according to the invention can also be used to produce homogeneous layers if the melting point, measured in [K], of the particles of the coating material is up to 90%, preferably up to 95%, more preferably up to 100% and still more preferably up to 105% of the temperature, measured in [K], of the medium used in the coating method, for example the gas stream, the combustion flame and/or the plasma flame. The above-named percentages relate to the ratio of the melting temperature of the coating material to the temperature of the gas stream in cold gas spraying, the combustion flame in flame spraying and high-speed flame spraying or the plasma flame in non-thermal or thermal plasma spraying in [K]. This applies in particular in the use of cold gas spraying and high-speed flame spraying. The thus-obtained coating has only a few free particle or grain structures, preferably none. The "homogeneous layers" according to the invention are characterized in that the produced layers have less than 10%, preferably less than 5%, more preferably less than 3%, still more preferably less than 1% and most preferably less than 0.1% cavities. In particular, it is preferred that no cavities at all are recognizable. The above-named term "cavity" within the meaning of the present invention describes the proportion of holes, incorporated in the coating, on the two-dimensional surface of a cross-section of the coated substrate, relative to the coating contained in the two-dimensional surface. A determination of this proportion is carried out by means of SEM at 30 randomly selected sites on the coating, wherein for example a length of 100 μm of the substrate coating is examined.

In addition, it was surprisingly found that the coatings according to the invention have a much improved heat conductivity. Without being understood as limiting the invention, the inventors are of the view that the coatings produced according to the invention have, for example as a result of their much higher homogeneity, a heat conductivity that is close to the heat conductivity of a homogeneous block of the corresponding coating material. This is attributed, inter alia, to the fact that no inclusions of air are contained which could hinder a heat conduction.

It was furthermore surprisingly shown that the barrier effect of the coatings according to the invention is dramatically increased. Without being understood as limiting the invention, the inventors are of the view that the coatings produced according to the invention have a denser structure, smoother surface and more uniform shape. As even isolated holes in the coating represent points of attack for example for a corrosion of the substrate, the coatings produced according to the invention with denser structure and more uniform shape provide a more reliable protection, even in the case of thin coatings, while the smoother surface provides fewer points of attack at which damage to the coating occurs for example through mechanical influences. Furthermore, through the coatings produced according to the invention, defined and reliable permeabilities of the coatings can also be realized, because, for the reasons named above, for example no indefinitely permeable gaps are present, the uniform formation of the coating provides a uniform barrier effect over the length of the coated substrate and mechanical influences do not readily result in damage to the coating.

The size distribution of the particles is preferably determined by means of laser granulometry. In this method, the particles can be measured in the form of a powder. The scattering of the irradiated laser light is detected in different spatial directions and evaluated according to the Fraunhofer diffraction theory. The particles are treated computationally as spheres. Thus, the determined diameters always relate to the equivalent spherical diameter determined over all spatial directions, irrespective of the actual shape of the particles. The size distribution is determined, calculated in the form of a volume average relative to the equivalent spherical diameter. This volume-averaged size distribution can be represented as a cumulative frequency distribution. The cumulative frequency distribution is characterized in a simplified manner by different characteristic values, for example the $D_{10}$, $D_{50}$ or $D_{90}$ value.

The measurements can be carried out for example with the particle-size analyzer HELOS from Sympatec GmbH, Clausthal-Zellerfeld, Germany.

In particular embodiments of the invention, it is preferred that the powdered coating material has a particle-size distribution with a $D_{50}$ value of at most 84 μm, preferably at most 79 μm, more preferably at most 75 μm and still more preferably at most 71 μm. In particular ones of the above-named embodiments, it is preferred in particular that the powdered coating material has a particle-size distribution with a $D_{50}$ value of at most 64 μm, preferably at most 61 μm, more preferably at most 59 μm and still more preferably at most 57 μm.

The term "$D_{50}$" within the meaning of the present invention denotes the particle size at which 50% of the above-named particle-size distribution volume-averaged by means of laser granulometry lies below the indicated value. The measurements can be carried out for example according to the above-named measurement method with a particle-size analyzer HELOS from Sympatec GmbH, Clausthal-Zellerfeld, Germany.

In particular embodiments of the invention, it is further preferred that the powdered coating material has a particle-size distribution with a $D_{50}$ value of at least 1.5 μm, preferably at least 2 μm, more preferably at least 4 μm and still more preferably at least 6 μm. In particular ones of the above-named embodiments, it is preferred in particular that the powdered coating material has a particle-size distribution with a $D_{50}$ value of at least 7 μm, preferably at least 9 μm, more preferably at least 11 μm and still more preferably at least 13 μm.

In particular embodiments, it is preferred in particular that the powder has a particle-size distribution with a $D_{50}$ value from a range of from 1.5 to 84 μm, preferably from a range of from 2 to 79 μm, more preferably from a range of from 4 to 75 μm and still more preferably from a range of from 6 to 71 μm. In particular ones of the above-named embodiments, it is preferred in particular that the powder has a particle-size distribution with a $D_{50}$ value from a range of from 7 to 64 μm, preferably from a range of from 9 to 61 μm, more preferably from a range of from 11 to 59 μm and still more preferably from a range of from 13 to 57 μm.

In other embodiments, it is preferred for example that the powder has a particle-size distribution with a $D_{50}$ value from a range of from 1.5 to 53 μm, preferably from a range of from 2 to 51 μm, more preferably from a range of from 2.5 to 50 μm and still more preferably from a range of from 3 to 49 μm. In particular ones of the above-named embodiments, it is preferred in particular that the powder has a particle-size distribution with a $D_{50}$ value from a range of from 3.5 to 48 μm, preferably from a range of from 4 to 47 μm, more preferably from a range of from 4.5 to 46 μm and still more preferably from a range of from 5 to 45 μm.

In still other embodiments, in contrast, it is preferred for example that the powder has a particle-size distribution with a $D_{50}$ value from a range of from 9 to 84 μm, preferably from a range of from 12 to 79 μm, more preferably from a range of from 15 to 75 μm, still more preferably from a range of from 17 to 71 μm. In particular ones of the above-named embodiments, it is preferred in particular that the powder has a particle-size distribution with a $D_{50}$ value from a range of from 19 to 64 μm, preferably from a range of from 21 to 61 μm, more preferably from a range of from 23 to 59 μm and still more preferably from a range of from 25 to 57 μm.

In further particular embodiments of the invention, it is preferred that the powdered coating material a particle-size distribution with a $D_{90}$ value of at most 132 μm, preferably at most 122 μm, more preferably at most 115 μm and still more preferably at most 109 μm. In particular ones of the above-named embodiments, it is preferred in particular that the powdered coating material has a $D_{90}$ value of at most 97 μm, preferably at most 95 μm, more preferably at most 91 μm and still more preferably at most 89 μm.

The term "$D_{90}$" within the meaning of the present invention denotes the particle size at which 90% of the above-named particle-size distribution volume-averaged by means of laser granulometry lies below the indicated value. The measurements can be carried out for example according to the above-named measurement method with a particle-size analyzer HELOS from Sympatec GmbH, Clausthal-Zellerfeld, Germany.

In particular embodiments, it is therefore preferred that the powdered coating material has a particle-size distribution with a $D_{90}$ value of at least 9 μm, preferably at least 11 μm, more preferably at least 13 μm and still more preferably at least 15 μm. In particular ones of the above-named embodiments, it is preferred in particular that the powdered coating material has a particle-size distribution with a $D_{90}$ value of at least 17 μm, preferably at least 19 μm, more preferably at least 21 μm and still more preferably at least 22 μm.

According to particular preferred embodiments, the powdered coating materials have a particle-size distribution with a $D_{90}$ value from a range of from 42 to 132 μm, preferably from a range of from 45 to 122 μm, more preferably from a range of from 48 to 115 μm and still more preferably from a range of from 50 to 109 μm. In particular ones of the above-named embodiments, it is preferred in particular that the powdered coating material has a $D_{90}$ value from a range of from 52 to 97 μm, preferably from a range of from 54 to 95 μm, more preferably from a range of from 56 to 91 μm and still more preferably from a range of from 57 to 89 μm.

In further particular embodiments of the invention, it is preferred that the powdered coating material has a particle-size distribution with a $D_{10}$ value of at most 9 μm, preferably at most 8 μm, more preferably at most 7.5 μm and still more preferably at most 7 μm. In particular ones of the above-named embodiments, it is preferred in particular that the powdered coating material has a particle-size distribution with a $D_{10}$ value of at most 6.5 μm, preferably at most 6 μm, more preferably at most 5.7 μm and still more preferably at most 5.4 μm.

The term "$D_{10}$" within the meaning of the present invention denotes the particle size at which 10% of the above-named particle-size distribution volume-averaged by means of laser granulometry lies below the indicated value. The measurements can be carried out for example according to the above-named measurement method with a particle-size analyzer HELOS from Sympatec GmbH, Clausthal-Zellerfeld, Germany.

On the other hand, the powdered coating materials with a high fines proportion also have a strong tendency to form fine dusts, which makes the handling of corresponding powders much more difficult. In particular embodiments, therefore, it is preferred that the powdered coating material has a particle-size distribution with a $D_{10}$ value of at least 0.2 μm, preferably at least 0.4 μm, more preferably at least 0.5 μm and still more preferably at least 0.6 μm. In particular ones of the above-named embodiments, it is preferred in particular that the powdered coating material has a particle-size distribution with a $D_{10}$ value of at least 0.7 μm, preferably 0.8 μm, more preferably 0.9 μm and still more preferably at least 1.0 μm.

In particular preferred embodiments, the powdered coating material is characterized in that it have a particle-size distribution with a $D_{10}$ value from a range of from 0.2 to 9 μm, preferably from a range of from 0.4 to 8 μm, more preferably from a range of from 0.5 to 7.5 μm and still more preferably from a range of from 0.6 to 7 μm. In particular ones of the above-named embodiments, it is preferred in particular that the powdered coating material has a particle-size distribution with a $D_{10}$ value from a range of from 0.7 to 6.5 μm, preferably from a range of from 0.8 to 6 μm, more preferably from a range of from 0.9 to 5.7 μm and still more preferably from a range of from 1.0 to 5.4 μm.

For example, in particular embodiments, it is preferred in particular that the powdered coating material has a particle-size distribution with a $D_{10}$ value of from 3.7 to 26 μm, a $D_{50}$ value of from 6 to 49 μm and a $D_{90}$ value of from 12 to 86 μm. In particular ones of the above-named embodiments, it is particularly preferred that the powdered coating material has a particle-size distribution with a $D_{10}$ value of from 5.8 to 26 μm, a $D_{50}$ value of from 11 to 46 μm and a $D_{90}$ value of from 16 to 83 μm. In particular ones of the above-named embodiments, it is still more preferred that the powdered coating material has a particle-size distribution with a $D_{10}$ value of from 9 to 19 μm, a $D_{50}$ value of from 16 to 35 μm and a $D_{90}$ value of from 23 to 72 μm.

In further particular embodiments, it is preferred for example that the powdered coating material has a particle-size distribution with a $D_{10}$ value of from 0.8 to 60 μm, a $D_{50}$ value of from 1.5 to 84 μm and a $D_{90}$ value of from 2.5 to 132 μm. In particular ones of the above-named embodiments, it is particularly preferred that the powdered coating material has a particle-size distribution with a $D_{10}$ value of from 2.2 to 56 μm, a $D_{50}$ value of from 4 to 79 μm and a $D_{90}$ value of from 4 to 122 μm. In particular ones of the above-named embodiments, it is still more preferred that the powdered coating material has a particle-size distribution with a $D_{10}$ value of from 2.8 to 49 μm, a $D_{50}$ value of from 6 to 71 μm and a $D_{90}$ value of from 9 to 109 μm.

In further particular embodiments, it is preferred for example that the powdered coating material has a particle-size distribution with a $D_{10}$ value of from 4.8 to 44 μm, a $D_{50}$ value of from 9 to 64 μm and a $D_{90}$ value of from 13 to 97 μm. In particular ones of the above-named embodiments, it is particularly preferred that the powdered coating material has a particle-size distribution with a $D_{10}$ value of from 12 to 41 μm, a $D_{50}$ value of from 23 to 59 μm and a $D_{90}$ value of from 35 to 91 μm. In particular ones of the above-named embodiments, it is still more preferred that the powdered coating material has a particle-size distribution with a $D_{10}$ value of from 15 to 39 μm, a $D_{50}$ value of from 28 to 57 μm and a $D_{90}$ value of from 41 to 89 μm.

Furthermore, it was observed that the conveyability of the powdered coating material is dependent on the width of the particle-size distribution. This width can be calculated by indicating the so-called span value, which is defined according to Formula (III):

$$\text{Span} = \frac{D_{90} - D_{10}}{D_{50}} \tag{III}$$

The inventors have found that in particular embodiments, for example, a still more uniform conveyability of the powdered coating material is achieved through the use of a powdered coating material with a smaller span, which further simplifies the formation of a more homogeneous and higher-quality layer. In particular embodiments, therefore, it is preferred that the span of the powdered coating material is at most 2.9, preferably at most 2.6, more preferably at most 2.4 and still more preferably at most 2.1. In particular ones of the above-named embodiments, it is preferred in particular that the span of the powdered coating material is at most 1.9, preferably at most 1.8, more preferably at most 1.7 and still more preferably at most 1.6.

On the other hand, the inventors have found that a very narrow span is not necessarily required to provide the sought conveyability, which makes the production of the powdered coating material easier. In particular embodiments, therefore, it is preferred that the span value of the powdered coating material is at least 0.4, preferably at least 0.5, more preferably at least 0.6 and still more preferably at least 0.7. In particular embodiments, it is preferred in particular that the span value of the powdered coating material is at least 0.8, preferably at least 0.9, more preferably at least 1.0 and still more preferably at least 1.1.

On the basis of the teaching disclosed herein, a person skilled in the art can select any combination, in particular of the above-named limit values of the span value, in order to provide the desired combination of properties. In particular embodiments, it is preferred for example that the powdered coating material has a span value from a range of from 0.4 to 2.9, preferably from a range of from 0.5 to 2.6, more preferably from a range of from 0.6 to 2.4 and still more preferably from a range of from 0.7 to 2.1. In particular ones of the above-named embodiments, it is preferred in particular that the powdered coating material has a span value from a range of from 0.8 to 1.9, preferably from a range of from 0.9 to 1.8, more preferably from a range of from 1.0 to 1.7 and still more preferably from a range of from 1.1 to 1.6.

A person skilled in the art is aware that, on the basis of the teaching disclosed herein, particular combinations of the span limit values or value ranges with the above-named preferred $D_{50}$ value ranges are preferred depending on the desired combination of advantages. For example, in particular preferred embodiments the powdered coating material has a particle-size distribution with a span from a range of from 0.4 to 2.9 and a $D_{50}$ value from a range of from 1.5 to 53 μm, preferably from a range of from 2 to 51 μm, more preferably from a range of from 4 to 50 μm, still more preferably from a range of from 6 to 49 μm and most preferably from a range of from 7 to 48 μm. In particular preferred ones of the above-named embodiments, the powdered coating material has a particle-size distribution with a span from a range of from 0.5 to 2.6 and a $D_{50}$ value from a range of from 1.5 to 53 μm, preferably from a range of from 2 to 51 μm, more preferably from a range of from 4 to 50 μm, still more preferably from a range of from 6 to 49 μm and most preferably from a range of from 7 to 48 μm. In particular further preferred embodiments, the powdered coating material has a particle-size distribution with a span from a range of from 0.6 to 2.4 and a $D_{50}$ value from a range of from 1.5 to 53 μm, preferably from a range of from 2 to 51 μm, more preferably from a range of from 4 to 50 μm, still more preferably from a range of from 6 to 49 μm and most preferably from a range of from 7 to 48 μm. In particular still further preferred embodiments, the powdered coating material has a particle-size distribution with a span from a range of from 0.7 to 2.1 and a $D_{50}$ value from a range of from 1.5 to 53 μm, preferably from a range of from 2 to 51 μm, more preferably from a range of from 4 to 50 μm, still more preferably from a range of from 6 to 49 μm and most preferably from a range of from 7 to 48 μm.

Furthermore, it was found that the density of the powdered coating material can influence the conveying of such powders in the form of an aerosol. Without being understood as limiting the invention, the inventors are of the view that the differences in inertia of particles that are the same size but have different densities lead to a different behavior of the aerosol streams of powdered coating materials with identical particle-size distribution. It can therefore prove to be difficult to transfer conveying methods which have been optimized for a specific $D_{50}$ to powdered coating materials with other densities. In particular embodiments, therefore, it is preferred that the upper limit of the span value is corrected dependent on the density of the powdered coating material used according to Formula V.

$$Span_{UC} = Span_U \cdot \left(\frac{\rho_{Alu}}{\rho_x}\right)^{\frac{1}{3}} \tag{V}$$

Here, $Span_{UC}$ is the corrected upper span value, $Span_U$ is the upper span value, $\rho_{Alu}$ is the density of aluminum (2.7 g/cm$^3$) and $\rho_X$ is the density of the powdered coating material used. However, it was furthermore found that the differences in the case of powdered coating materials with a lower density than aluminum are only slight, and a selection, optimized in this respect, of the powdered coating material does not result in a noticeable improvement in the conveyability. A powdered coating material with an uncorrected upper span value is therefore used for powdered coating materials with a density lower than the density of aluminum.

Coating methods that can be used according to the invention are known to a person skilled in the art under the names cold gas spraying, thermal plasma spraying, non-thermal plasma spraying, flame spraying and high-speed flame spraying.

Cold gas spraying is characterized in that the powder to be applied is not melted in the gas jet, but the particles are greatly accelerated and, as a result of their kinetic energy, form a coating on the surface of the substrate. Here, various gases known to a person skilled in the art can be used as carrier gas, such as nitrogen, helium, argon, air, krypton, neon, xenon, carbon dioxide, oxygen or mixtures thereof. In particular variants, it is preferred in particular that air, helium or mixtures thereof are used as gas.

Gas speeds of up to 3000 m/s are achieved through a controlled expansion of the above-named gases in a corresponding nozzle. The particles can be accelerated here to up to 2000 m/s. However, in particular variants of cold gas spraying, it is preferred that the particles achieve speeds for example of between 300 m/s and 1600 m/s, preferably between 1000 m/s and 1600 m/s, more preferably between 1250 m/s and 1600 m/s.

A disadvantage is, for example, the strong generation of noise which is brought about by the high speeds of the gas streams used.

In flame spraying, for example, a powder is converted to the liquid or plastic state by means of a flame and then applied to a substrate as coating. Here, e.g. a mixture of oxygen and a combustible gas such as acetylene or hydrogen is combusted. In particular variants of flame spraying, some of the oxygen is used to transport the powdered coating material into the combustion flame. The particles achieve speeds of between 24 and 31 m/s in customary variants of this method. Similarly to flame spraying, in high-speed flame spraying, for example, a powder is also converted to a liquid or plastic state by means of a flame. However, the particles are accelerated to significantly higher speeds compared with the above-named method. In specific examples of the above-named method, for example, a speed of the gas stream of from 1220 to 1525 m/s with a speed of the particles of from approx. 550 to 795 m/s is named. In further variants of this method, however, gas speeds of over 2000 m/s are also achieved. In general, in customary variants of the previous method, it is preferred that the speed of the flame lies between 1000 and 2500 m/s. Furthermore, in customary variants, it is preferred that the flame temperature lies between 2200° C. and 3000° C. The temperature of the flame is thus comparable to the temperature in flame spraying. This is achieved by combusting the gases under a pressure of from approx. 515 to 621 kPa, followed by expansion of the combustion gases in a nozzle. In general, the view is taken that coatings produced here have a higher density than, for example, coatings obtained by the flame spraying method.

Detonation/explosive flame spraying can be viewed as a subtype of high-speed flame spraying. Here, the powdered coating material is strongly accelerated by repeated detonations of a gas mixture such as acetylene/oxygen, wherein for example particle speeds of approx. 730 m/s are achieved. The detonation frequency of the method here is for example between approx. 4 and 10 Hz. In variants such as the so-called high frequency gas detonation spraying, however, detonation frequencies of around approx. 100 Hz are also chosen.

The layers obtained are usually supposed to have a particularly high hardness, strength, density and good binding to the substrate surface. A disadvantage in the above-named methods is the increased safety costs, as well as for example the high noise load because of the high gas speeds.

In thermal plasma spraying, for example, a direct current arc furnace is passed through by a primary gas such as argon at a speed of 40 l/min and a secondary gas such as hydrogen at a speed of 2.5 l/min, wherein a thermal plasma is generated. Then, for example, 40 g/min of the powdered coating material is fed in with the aid of a carrier gas stream, which is passed into the plasma flame at a speed of 4 l/min. In usual variants of thermal plasma spraying, the conveying rate of the powdered coating material is between 5 g/min and 60 g/min, more preferably between 10 g/min and 40 g/min.

In particular variants of the method, it is preferred to use argon, helium or mixtures thereof as ionizable gas. The whole gas stream is furthermore preferably 30 to 150 SLPM (standard liters per minute) in particular variants. The electrical power used to ionize the gas stream, without the heat energy dissipated as a result of cooling, can be selected for example between 5 and 100 kW, preferably between 40 and 80 kW. Here, plasma temperatures of between 4000 K and a few 10000 K can be achieved.

In non-thermal plasma spraying, a non-thermal plasma is used to activate the powdered coating material. The plasma used here is generated for example with a barrier discharge or corona discharge with a frequency of from 50 Hz to 1 MHz. In particular variants of non-thermal plasma spraying, it is preferred that work is done at a frequency of from 10 kHz to 100 kHz. The temperature of the plasma here is preferably less than 3000 K, preferably less than 2500 K and still more preferably less than 2000 K. This minimizes the technical outlay and keeps the input of energy into the coating material to be applied as low as possible, which in turn allows a gentle coating of the substrate. The order of magnitude of the temperature of the plasma flame is thus preferably comparable to that of flame spraying or of high-speed flame spraying. Non-thermal plasmas the core temperature of which is below 1173 K or even below 773 K in the core region can also be generated by targeted choice of the parameters. The temperature in the core region is measured here, for example, using an NiCr/Ni thermocouple and a spray diameter of 3 mm at a distance of 10 mm from the nozzle outlet in the core of the emerging plasma jet at ambient pressure. Such non-thermal plasmas are suitable in particular for coatings of very temperature-sensitive substrates.

To produce coatings with sharp boundaries without the need to cover areas in a targeted manner, it has proved to be advantageous to design, in particular, the outlet opening for the plasma flame such that the track widths of the coatings produced lie between 0.2 mm and 10 mm. This makes a very precise, flexible, energy-efficient coating possible while making the best possible use of the coating material used. For example, a distance of 1 mm is chosen as the distance from the spray lance to the substrate. This makes possible as great a flexibility as possible of the coatings and, at the same time, guarantees high-quality coatings. The distance between spray lance and substrate expediently lies between 1 mm and 35 mm.

Various gases known to a person skilled in the art and mixtures thereof can be used as ionizable gas in the non-thermal plasma method. Examples of these are helium, argon, xenon, nitrogen, oxygen, hydrogen or air, preferably argon or air. A particularly preferred ionizable gas is air.

For example to reduce the noise load, it can also be preferred here that the speed of the plasma stream lies below 200 m/s. For example, a value of between 0.01 m/s and 100 m/s, preferably between 0.2 m/s and 10 m/s, can be chosen as the flow rate. In particular embodiments, it is preferred in particular for example that the volume flow of the carrier gas lies between 10 and 25 l/min, more preferably between 15 and 19 l/min.

According to a preferred embodiment, the particles of the powdered coating material are preferably metallic particles or metal-containing particles. It is preferred in particular that the metal content of the metallic particles or metal-containing particles is at least 95 wt.-%, preferably at least 99 wt.-%, still more preferably at least 99.9 wt.-%. In particular preferred embodiments, the metal is, or the metals are, selected from the group consisting of silver, gold, platinum, palladium, vanadium, chromium, manganese, cobalt, germanium, antimony, aluminum, zinc, tin, iron, copper, nickel, titanium, silicon, alloys and mixtures thereof. In particular ones of the above-named embodiments, it is preferred in particular that the metal is, or the metals are, selected from the group consisting of silver, gold, aluminum, zinc, tin, iron, copper, nickel, titanium, silicon, alloys and mixtures thereof, preferably from the group consisting of silver, gold, aluminum, zinc, tin, iron, nickel, titanium, silicon, alloys and mixtures thereof.

According to further preferred embodiments of the method according to the invention, the metal or the metals of the particles of the powdered coating material is or are selected from the group consisting of silver, aluminum, zinc, tin, copper, alloys and mixtures thereof. In particular, metallic particles or metal-containing particles in which the metal is, or the metals are, selected from the group consisting of silver, aluminum and tin have proved to be particularly suitable particles in specific embodiments.

In further embodiments of the invention, the powdered coating material consists of inorganic particles which are preferably selected from the group consisting of carbonates, oxides, hydroxides, carbides, halides, nitrides and mixtures thereof. Mineral and/or metal-oxide particles are particularly suitable.

In other embodiments, the inorganic particles are alternatively or additionally selected from the group consisting of carbonaceous particles or graphite particles.

A further possibility is the use of mixtures of the metallic particles and the above-named inorganic particles, such as for example mineral and/or metal-oxide particles, and/or the particles which are selected from the group consisting of carbonates, oxides, hydroxides, carbides, halides, nitrides and mixtures thereof.

Furthermore, the powdered coating material can comprise or consist of glass particles. In particular embodiments, it is preferred in particular that the powdered coating material comprises or consists of coated glass particles.

In addition, in particular embodiments, the powdered coating material comprises or consists of organic and/or inorganic salts.

In still other embodiments of the present invention, the powdered coating material comprises or consists of plastic particles. The above-named plastic particles are formed for example from pure or mixed homo-, co-, block or prepolymers or mixtures thereof. Here, the plastic particles can be pure crystals or be mixed crystals or have amorphous phases. The plastic particles can be obtained for example by mechanical comminution of plastics.

In particular embodiments of the method according to the invention, the powdered coating material comprises or consists of mixtures of particles of different materials. In particular preferred embodiments, the powdered coating material consists in particular of at least two, preferably three, different particles of different materials.

The particles can be produced via different methods. For example, the metal particles can be obtained by spraying or atomizing molten metals. Glass particles can be produced by mechanical comminution of glass or else from the melt. In the latter case, the glass melt can likewise be atomized or nebulized. Alternatively, melted glass can also be comminuted on rotating elements, for example a drum. Mineral particles, metal-oxide particles and inorganic particles which are selected from the group which consists of oxides, hydroxides, carbonates, carbides, nitrides, halides and mixtures thereof can be obtained by comminuting the naturally occurring minerals, stones, etc. and then screening them by size.

The screening by size can be carried out for example by means of cyclones, air separators, screens, etc.

In particular embodiments of the present invention, the easily deformable particles according to the invention of the powdered coating material have been provided with a coating in order for example to provide an improved oxidation stability during the storage of the powdered coating material.

In particular preferred embodiments of the present invention, the above-named coating can comprise a metal or consist of a metal. Such a coating of a particle can be formed closed or particulate, wherein coatings with a closed structure are preferred. The layer thickness of such a metallic coating preferably lies below 1 μm, more preferably below 0.8 μm and still more preferably below 0.5 μm. In particular embodiments, such coatings have a thickness of at least 0.05 μm, more preferably of at least 0.1 μm. Metals that are particularly preferred in particular embodiments for use in one of the above-named coatings, preferably as main constituents, are selected from the group consisting of copper, titanium, gold, silver, tin, zinc, iron, silicon, nickel and aluminum, preferably from the group consisting of gold, silver, tin and zinc, further preferably from the group consisting of silver, tin and zinc. The term main constituent within the meaning of the above-named coating denotes that the relevant metal or a mixture of the above-named metals represents at least 90 wt.-%, preferably 95 wt.-%, further preferably 99 wt.-% of the metal content of the coating. It must be understood that, in the case of a partial oxidation, the oxygen proportion of the corresponding oxide layer is not taken into account. Such metallic coatings can be produced for example by means of gas-phase synthesis or wet-chemical methods.

In further particular embodiments, the particles according to the invention of the powdered coating material are additionally or alternatively coated with a metal oxide layer. Preferably, this metal oxide layer substantially consists of silicon oxide, aluminum oxide, boron oxide, zirconium oxide, cerium oxide, iron oxide, titanium oxide, chromium oxide, tin oxide, molybdenum oxide, oxide hydrates thereof, hydroxides thereof and mixtures thereof. In particular preferred embodiments, the metal oxide layer substantially consists of silicon oxide. The above-mentioned term, "substantially consists of", within the meaning of the present invention means that at least 90%, preferably at least 95%, more preferably at least 98%, still more preferably at least 99% and most preferably at least 99.9% of the metal oxide layer consists of the above-named metal oxides, in each case relative to the number of particles of the metal oxide layer, wherein any water contained is not factored in. The composition of the metal oxide layer can be determined by means of methods known to a person skilled in the art, such as for example sputtering in combination with XPS or TOF-SIMS. In particular ones of the above-named embodiments, it is preferred in particular that the metal oxide layer does not represent an oxidation product of a metal core located underneath it. Such a metal oxide layer can be applied for example using the sol-gel method.

In particular preferred embodiments, the substrate is selected from the group consisting of plastic substrates, inorganic substrates, cellulose-containing substrates and mixtures thereof.

The plastic substrates can be for example plastic films or shaped bodies made of plastics. The shaped bodies can have geometrically simple or complex shapes. The plastic shaped body can be for example a component from the automotive industry or the construction industry.

The cellulose-containing substrates can be cardboard, paper, wood, wood-containing substrates, etc.

The inorganic substrates can be for example metallic substrates, such as metal sheets or metallic shaped bodies or ceramic or mineral substrates or shaped bodies. The inorganic substrates can also be solar cells or silicon wavers, to which for example electrically conductive coatings or contacts are applied.

Substrates made of glass, such as for example glass panes, can also be used as inorganic substrates. The glass, in particular glass panes, can be provided for example with electrochromic coatings using the method according to the invention.

The substrates coated by means of the method according to the invention are suitable for very different uses.

In particular embodiments, the coatings have optical and/or electromagnetic effects. Here, the coatings can bring about reflections or absorptions. Furthermore, the coatings can be electrically conductive, semi-conductive or non-conductive.

Electrically conductive layers can be applied for example in the form of strip conductors to components. This can be used for example to make current-carrying possible within the framework of the on-board power supply in an automobile component. Furthermore, such a strip conductor can, however, also be formed for example as an antenna, as a shield, as an electrical contact, etc. This is particularly advantageous for example for RFID applications (radio frequency identification). Furthermore, coatings according to the invention can be used for example for heating purposes or for the targeted heating of specific components or specific parts of larger components.

In further particular embodiments, the coatings produced act as sliding layers, diffusion barriers for gases and liquids, wear and/or corrosion protection layers. Furthermore, the coatings produced can influence the surface tension of liquids or have adhesion-promoting properties.

The coatings produced according to the invention can furthermore be used as sensor surfaces, for example as human-machine interface (HMI), for example in the form of a touchscreen. The coatings can likewise be used to shield from electromagnetic interferences (EMI) or to protect against electrostatic discharges (ESD). The coatings can also be used to bring about electromagnetic compatibility (EMC).

Furthermore, through the use of the particles according to the invention, layers can be applied which are applied for example to increase the stability of corresponding components after repair. An example is repairs in the aviation sector, wherein for example a loss of material as a result of processing steps must be compensated for, or a coating is to be applied for example for stabilization. This proves to be difficult for aluminum components for example, and normally requires post-processing steps such as sintering. In contrast, by means of the methods according to the invention, firmly adhering coatings can be applied under very gentle conditions, without post-processing steps such as sintering even being required.

In still other embodiments, the coatings act as electrical contacts and allow an electrical connection between different materials.

A person skilled in the art is aware that the specifications indicated above with regard to the method according to the invention in respect of the powdered coating material and the particles contained therein also apply correspondingly to the use of the powdered coating material and the particles contained therein, and vice versa.

FIGURES

Figure 2:
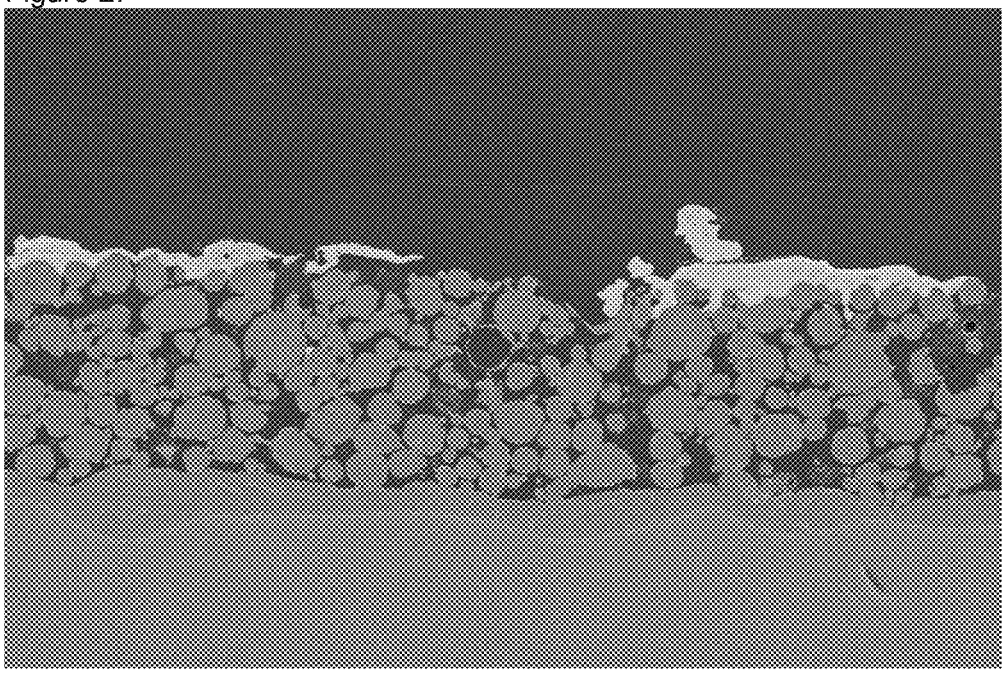
FIG. 2 is an SEM photograph of a different section of a wafer which was coated first by means of solar contact paste and then by means of non-thermal plasma spraying, wherein a powdered copper coating material according to the invention was used.
Figure 3:
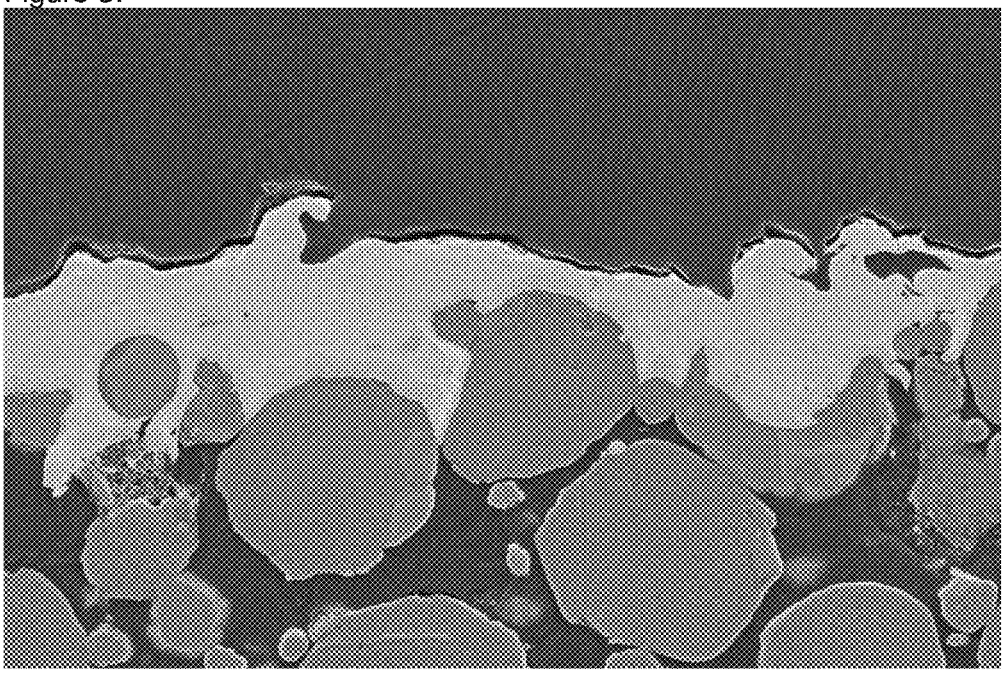
FIG. 3 is an SEM photograph of a different section of a wafer which was coated first by means of solar contact paste and then by means of non-thermal plasma spraying, wherein a powdered copper coating material according to the invention was used.
Figure 4:
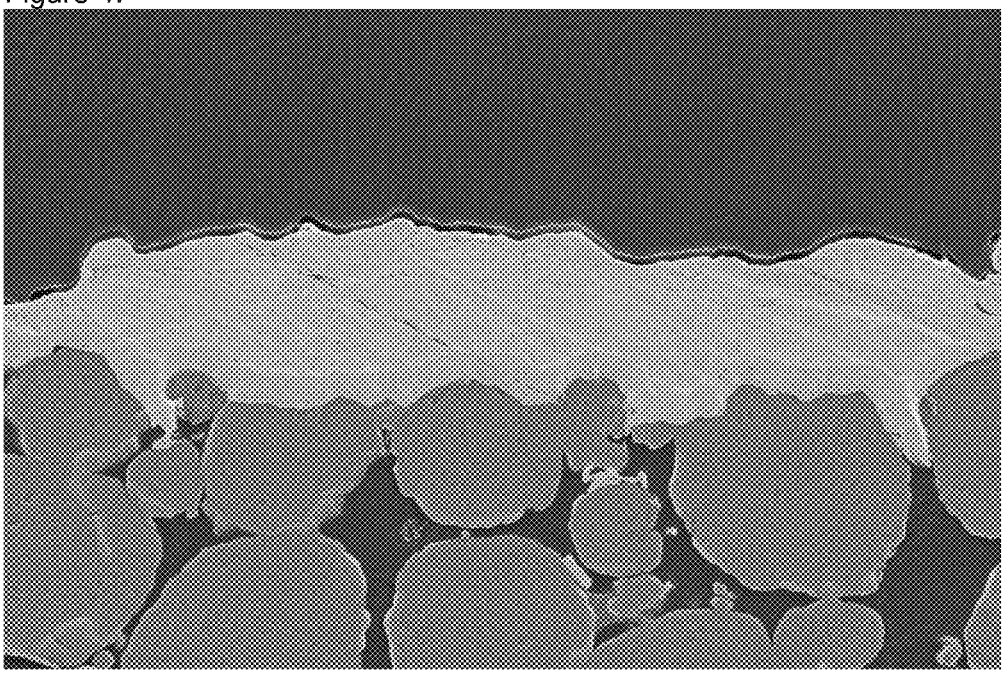
FIG. 4 is an SEM photograph of a different section of a wafer which was coated first by means of solar contact paste and then by means of non-thermal plasma spraying, wherein a powdered copper coating material according to the invention was used.

FIGS. 1 to 4 show a wafer which was coated first by means of solar contact paste and then by means of non-thermal plasma spraying, wherein a powdered copper coating material according to the invention was used.

EXAMPLES

Materials and Methods Used

The size distribution of the particles of the powdered coating materials used was determined by means of a HELOS device (Sympatec, Germany). For the measurement, 3 g of the powdered coating material was introduced into the measuring device and treated, before the measurement, with ultrasound for 30 seconds. For the dispersion, a Rodos T4.1 dispersing unit was used, wherein the primary pressure was 4 bar. The evaluation was carried out with the device's standard software.

The method according to the invention is now explained in more detail with reference to the following examples, without being limited to the examples.

Example 1

Flame Spraying of Copper Particles

Using a flame spraying system from CASTOLIN, spherical copper particles which have a relative deformability of approx. 0.6, with a $D_{50}$ value of 54 μm (comparison example 1.1), as well as copper particles with a relative deformability factor of 0.03 and a $D_{50}$ value of 55 μm (Example 1.2 according to the invention) were applied to a metal sheet by means of an oxy-acetylene flame. The obtained metal sheets were examined by means of SEM.

It is shown even during spraying of the powdered coating material to be used according to the invention that much less material sprays off from the metal sheet. The metal sheet coated according to the invention is much more homogeneous in relation to its optics as well as its haptics. SEM photographs of the surfaces demonstrate the formation of larger uniform areas of the coating, while the surface of the comparison example is characterized by a large number of isolated particles. Furthermore, the cross-section shows that cavities contained in the coating of the metal sheet according to the invention are significantly smaller.

Example 2

Non-Thermal Plasma Spraying of Copper Particles

The powdered coating material was applied by means of a Plasmatron system from Inocon, Attnang-Puchheim, Austria. Argon was used as ionizable gas. Standard process parameters were used here.

Here, a powdered coating material not according to the invention with a relative deformability factor of 0.6 and a $D_{50}$ of 25 μm, as well as a powdered coating material according to the invention with a relative deformability factor of 0.009 and a $D_{50}$ of 35 μm were used. A wafer coated with solar contact paste served as substrate. Here it was observed that the higher energies that are normally chosen by a person skilled in the art to apply the powdered coating materials can result in damage to the wafer. In contrast, under gentler conditions, with a powdered coating material with a relative deformability factor of 0.6 satisfactory coatings were no longer achieved as for example the adhesion of the coatings was no longer satisfactory.

In contrast, the powdered coating materials according to the invention make an application possible even under very gentle conditions. For example, a very low application speed and/or a very low temperature can be chosen. FIGS. 1 to 4 show different sections of an applied powdered coating material according to the invention. The applied coating adapts well to the non-uniform surface structure of the solar contact paste and even partially penetrates it without impairing the structure of the solar contact paste or even damaging the wafer.

The invention claimed is:

1. A process for producing a coating on a substrate, comprising:

introducing a particle-containing powdered coating material in a coating method selected from the group consisting of cold gas spraying, flame spraying, high-speed flame spraying, thermal plasma spraying and non-thermal plasma spraying for coating a substrate, wherein the particles have a relative deformability factor $V_m$ of at most 0.1 and the relative deformability factor is defined according to Formula (I):

$$V_m = \frac{d}{D_{50}}, \tag{I}$$

wherein d is the average smallest thickness of the particles, measured vertical to and in the middle half of the longitudinal axis of the particles, and $D_{50}$ is the average diameter of the volume-averaged particle-size distribution.

2. The process according to claim 1, wherein the relative deformability factor is defined according to Formula (II) taking into account the Mohs hardness of the particles relative to the Mohs hardness of silver:

$$V_m = \frac{d}{D_{50}} \cdot \frac{H_X}{H_{Ag}}, \tag{II}$$

wherein $H_X$ is the Mohs hardness of the particles and $H_{Ag}$ is the Mohs hardness of silver.

3. The process according to claim 1, wherein the relative deformability factor of the powdered coating material is at most 0.01.

4. The process according to claim 1, wherein the particles of the powdered coating material have a technical elastic limit of more than 45 N/mm$^2$.

5. The process according to claim 1, wherein the melting point, measured in [K], of the particles of the coating material is at most 60% of the temperature, measured in [K], of the medium utilized in the coating method directed onto the substrate.

6. The process according to claim 1, wherein the particles comprise metal particles, and the metal is selected from the group consisting of silver, gold, platinum, palladium, vanadium, chromium, manganese, cobalt, germanium, antimony, aluminum, zinc, tin, iron, copper, nickel, titanium, silicon, alloys and mixtures thereof.

7. The process according to claim 1, wherein the coating method is selected from the group consisting of flame spraying and non-thermal plasma spraying.

8. The process according to claim 1, wherein the powdered coating material has a particle-size distribution with a $D_{50}$ value from a range of from 1.5 to 84 μm.

9. The process according to claim 1, wherein the powdered coating material has a particle-size distribution with a $D_{10}$ value from a range of from 3.7 to 26 μm, a $D_{50}$ value from a range of from 6 to 49 μm and a $D_{90}$ value from a range of from 12 to 86 μm.

10. The process according to claim 1, wherein the span of the powdered coating material is at most 2.9, wherein the span is defined according to Formula (III):

$$\text{Span} = \frac{D_{90} - D_{10}}{D_{50}}. \tag{III}$$

11. The process according to claim 1, wherein the particles of the powdered coating material are at least partially coated.

12. A method for coating a substrate selected from the group consisting of cold gas spraying, flame spraying, high-speed flame spraying, thermal plasma spraying and non-thermal plasma spraying, the method comprising:

(a) introducing a particle-containing powdered coating material into a medium directed onto a substrate to be coated by cold gas spraying, flame spraying, high-speed flame spraying, thermal plasma spraying or non-thermal plasma spraying, wherein the particles have a relative deformability factor $V_m$ of at most 0.1 and the relative deformability factor is defined according to Formula (I):

$$V_m = \frac{d}{D_{50}}, \tag{I}$$

wherein d is the average smallest thickness of the particles, measured vertical to and in the middle half of the longitudinal axis of the particles, and $D_{50}$ is the average diameter of the volume-averaged particle-size distribution; and (b) depositing the powdered coating material onto the substrate.

13. The method according to claim 12, wherein the coating method is selected from the group consisting of flame spraying and non-thermal plasma spraying.

14. The method according to claim 12, wherein the powdered coating material is conveyed as an aerosol.

15. The method according to claim 12, wherein the medium directed onto the substrate is air or has been produced from air.

16. The process according to claim 1, wherein the coating method is non-thermal plasma spraying.

17. The method according to claim 12, wherein the coating method is non-thermal plasma spraying.

18. The process according to claim 1, wherein the powdered coating material comprises metallic particles or metal-containing particles.

19. The process according to claim 1, wherein the powdered coating material comprises inorganic particles.

20. The process according to claim 19, wherein the inorganic particles are selected from the group consisting of carbonates, oxides, hydroxides, carbides, halides, nitrides and mixtures thereof.

21. The process according to claim 1, wherein the powdered coating material comprises of organic and/or inorganic salts.

22. The process according to claim 1, wherein the powdered coating material comprises plastic particles.

23. The process according to claim 1, wherein the particles of the powdered coating material comprise a coating comprising metal.

24. A coating produced according to the process of claim 1.

25. A coated substrate produced according to the method of claim 12.

* * * * *